US006722262B2

(12) United States Patent
Ball et al.

(10) Patent No.: US 6,722,262 B2
(45) Date of Patent: Apr. 20, 2004

(54) PNEUMATIC ACTUATOR WITH A NESTED DIAPHRAGM ASSEMBLY

(75) Inventors: Larry K. Ball, Chandler, AZ (US); Betty Kocsis, Phoenix, AZ (US); John N. Tervo, Scottsdale, AZ (US)

(73) Assignee: Honeywell International, Inc., Morristown, NJ (US)

( * ) Notice: Subject to any disclaimer, the term of this patent is extended or adjusted under 35 U.S.C. 154(b) by 26 days.

(21) Appl. No.: 10/247,193

(22) Filed: Sep. 19, 2002

(65) Prior Publication Data

US 2003/0167917 A1 Sep. 11, 2003

Related U.S. Application Data

(60) Provisional application No. 60/362,228, filed on Mar. 6, 2002.

(51) Int. Cl.[7] ..... F01B 19/00
(52) U.S. Cl. ..... 92/103 R; 92/98 R; 92/103 F
(58) Field of Search ..... 92/103 F, 103 SD, 92/103 R, 98 R, 86, 98 D

(56) References Cited

U.S. PATENT DOCUMENTS 2,478,575 A * 8/1949 Fitch ..... 92/103 R
3,145,659 A * 8/1964 Svendsen ..... 417/380
3,323,423 A 6/1967 Prohaska
3,417,671 A * 12/1968 Stevenson et al. ..... 92/103 R
4,014,514 A 3/1977 Priese et al.
4,741,252 A 5/1988 Harter et al.
4,821,776 A * 4/1989 Ariizumi et al. ..... 137/625.4
4,989,497 A 2/1991 Lerma
5,540,568 A 7/1996 Rosen et al.
5,992,297 A 11/1999 Plantan et al.
6,189,435 B1 2/2001 Vertanen et al.
6,349,629 B1 2/2002 Plantan et al.

FOREIGN PATENT DOCUMENTS

GB 1 298 037 11/1972
WO 03/06759 7/2003

* cited by examiner

*Primary Examiner*—Edward K. Look
*Assistant Examiner*—Michael Leslie
(74) *Attorney, Agent, or Firm*—Robert Desmond, Esq.

(57) ABSTRACT

A diaphragm assembly for use in pneumatic actuators uses two or more diaphragms, one nested inside of the other. Each of the diaphragms, when shaped, includes a fabric pattern. The fabric patterns on each of the diaphragms are aligned one with another upon installation into a pneumatic actuator.

26 Claims, 3 Drawing Sheets

PNEUMATIC ACTUATOR WITH A NESTED DIAPHRAGM ASSEMBLY

CROSS-REFERENCE TO RELATED APPLICATIONS

This application claims the benefit of U.S. Provisional Application No. 60/362,228, filed Mar. 6, 2002.

FIELD OF THE INVENTION

The present invention relates to pneumatic actuators and, more specifically, to a diaphragm assembly for use in pneumatic actuators, in which two or more diaphragms are aligned and nested one on top of another for use in aircraft or other vehicles.

BACKGROUND OF THE INVENTION

Pneumatic actuators may be found in various applications such as commercial vehicles and aerospace applications. Though pneumatic actuators may be one of the most cost-effective linear actuators, they may be short lived when exposed to high temperatures and pressures. Generally, such low lifespan may be due in part to the wearing of the diaphragm.

A typical pneumatic actuator may include at least a housing, a diaphragm, and a diaphragm support structure. The diaphragm may be made from a flat sheet of fabric, and may be coated on at least one side with an elastomer. In some instances, the diaphragm support structure may have an outer periphery that is generally cylindrical in shape. Thus, the diaphragm may be formed into a so-called "top hat" shape, to conform at least a portion of the diaphragm into a shape that is consistent with the outer periphery of the diaphragm support structure. Because the diaphragm fabric was originally flat, with the fabric weave crossing at right angles, this new shape may cause some of the fabric weave to form a "rainbow-pattern" area when viewed from the diaphragm's outside.

During the operation of the actuator, the diaphragm may be exposed to numerous pressure cycles. Although actuators and presently used diaphragms are robustly designed and operate safely, in some instances the diaphragm in some actuators may become worn and potentially become inoperative. One particular type of diaphragm failure that may occur following repeated pressure cycles is known as a "curtain failure." A curtain failure may be recognized as a slit in the diaphragm fabric, and a "puckered-out" region may surround the slit on the diaphragm fabric's elastomer side.

When the diaphragm fails, the actuator may no longer operate, or not operate correctly. Thus, the actuator may need to be disassembled to effect diaphragm replacement, which can increase overall cost. Hence, there is a need for a diaphragm assembly that may be used in a pneumatic actuator that is less prone to curtain failure and/or is relatively inexpensive to make and/or reduces maintenance and repair costs associated with pneumatic actuators. The present invention addresses one or more of these needs.

SUMMARY OF THE INVENTION

The diaphragm assembly provides a diaphragm structure that is relatively low in cost, has an increased diaphragm life, and can reduce overall maintenance and repair costs for the pneumatic actuators into which it is installed.

In one embodiment, and by way of example only, a pneumatic actuator assembly includes a housing and a diaphragm assembly. The housing has an internal chamber and at least a first fluid port in fluid communication with the internal chamber. The diaphragm assembly is located in the internal chamber of the housing to prevent fluid communication between a first portion of the internal chamber and a second portion of the internal chamber. The first portion of the internal chamber is in fluid communication with the fluid port. The diaphragm assembly has a first diaphragm and a second diaphragm. The first and second diaphragms each have an upper surface and a lower surface. The second diaphragm upper surface is positioned adjacent the first diaphragm lower surface. Each of the first and second diaphragms has a fabric portion and has at least a portion of one of its surfaces covered with an elastomeric material. Each fabric portion has at least one fabric pattern, and the fabric patterns of the first and second diaphragms are substantially aligned with one another.

In another exemplary embodiment, a diaphragm assembly includes a first diaphragm and a second diaphragm. The first diaphragm has an outer surface and an inner surface. The second diaphragm has an outer surface and an inner surface, and the second diaphragm outer surface is positioned adjacent the first diaphragm inner surface. Each of the first and second diaphragms is made of a fabric material and has at least a portion of at least one of its surfaces covered with an elastomeric material. The fabric has at least one fabric pattern, and the fabric patterns of the first and second diaphragms are substantially aligned with one another.

In yet another exemplary embodiment, a diaphragm assembly includes a first fabric diaphragm and a second fabric diaphragm. The first fabric diaphragm has a first fabric portion having at least one fabric pattern therein. The second fabric diaphragm has a second fabric portion having at least one fabric pattern therein. Each fabric pattern of the first diaphragm is substantially aligned with each fabric pattern of the second diaphragm.

In still a further exemplary embodiment, in an actuator having a housing assembly and a single diaphragm mounted therein, a method of modifying the actuator includes disassembling at least a portion of the housing assembly. The diaphragm is removed from the housing assembly, and a diaphragm assembly is then installed within the housing assembly. The diaphragm assembly includes at least first and second diaphragms positioned adjacent one another.

In yet still a further embodiment, an actuator including a housing assembly having a first diaphragm mounted therein, the first diaphragm including a fabric portion having at least one fabric pattern, a method of modifying the actuator disassembling at least a portion of the housing assembly. At least a second diaphragm is installed within the housing assembly and positioned adjacent the first diaphragm. The second diaphragm includes a fabric portion having at least one fabric pattern, and the fabric patterns of the first and second diaphragms are substantially aligned with one another.

Other independent features and advantages of the preferred actuator diaphragm assembly will become apparent from the following detailed description, taken in conjunction with the accompanying drawings which illustrate, by way of example, the principles of the invention.

DETAILED DESCRIPTION OF VARIOUS EMBODIMENTS

Figure 1:
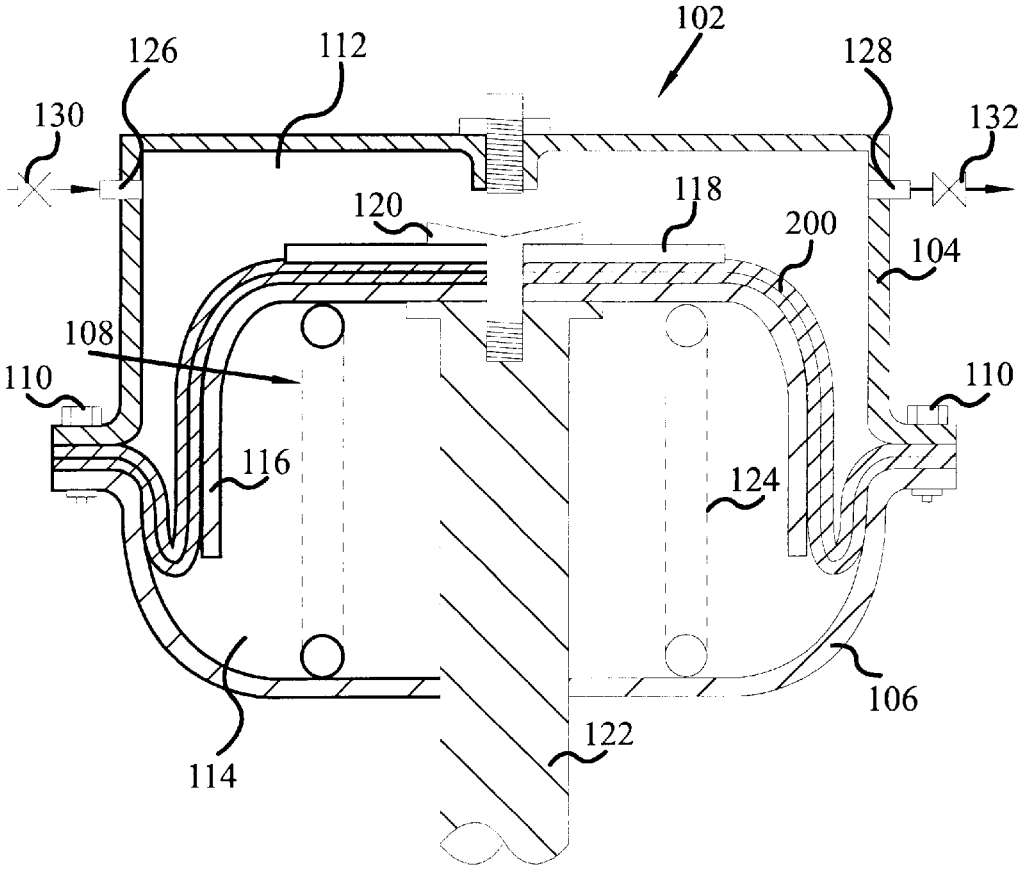
FIG. 1 is a cross sectional view of an exemplary pneumatic actuator that may employ the diaphragm assembly of the present invention.

Now, with reference to the drawings, an actuator embodying the invention will be discussed. Turning first to FIG. 1, a cross sectional view of an exemplary actuator 100 that may employ the diaphragm assembly of the present embodiment is shown. As this figure illustrates, the actuator 100 includes a housing assembly 102, that is made up of an upper housing section 104 and a lower housing section 106. The upper housing section 104 is coupled to the lower housing section 106 to form an internal chamber 108 within the housing assembly 102. The upper 104 and lower 106 housing sections are preferably coupled together by, for example, threaded fasteners 110, such as nuts bolts, located around the circumference of the upper 104 and lower 106 housing sections. It will be appreciated that other suitable structure could be used to couple the housing sections together.

An exemplary diaphragm assembly 200 is mounted within the housing assembly 102. In the depicted embodiment, a peripheral portion of the diaphragm assembly 200 is positioned between the upper 104 and lower 106 diaphragm sections, and is thereby clamped in place. It will be appreciated that other suitable structure could be used to clamp the diaphragm assembly 200 in place. With this configuration, the diaphragm assembly 200 divides the internal chamber 108 into at least two portions, a first portion 112 and a second portion 114. As will be discussed in further detail below, the diaphragm assembly 200 preferably includes two or more nested diaphragms.

A diaphragm support 116 is mounted below the diaphragm assembly 200 and moves with, and provides support to, the diaphragm assembly 200. In the depicted embodiment, a diaphragm backing plate 118 is positioned over a portion of the diaphragm assembly 200. A threaded stopscrew 120 extends through the backing plate 118, the diaphragm assembly 200, the support 116, and is threadedly coupled to a push rod 122. The push rod 122 may be coupled to a particular component such as, for example, a valve (not illustrated), the operation of which is be controlled by the actuator 100.

A spring 124 is mounted within the chamber 108 between the diaphragm support 116 and a bottom inside of the lower housing section 106. The spring 124 is configured to bias the diaphragm support 116 upward (relative to the view in FIG. 1). In the depicted embodiment, the upper housing section 104 additionally includes a fluid inlet port 126 and a fluid outlet port 128, each of which extends through the upper housing section 104 and are in fluid communication with the internal chamber first portion 112. The fluid inlet 126 and outlet 128 ports allow entry and exit of fluid from an external supply system (not shown). It will be appreciated that the configuration and number of the fluid inlet 126 and outlet 128 ports depicted in FIG. 1 is merely exemplary, and that other suitable configurations and numbers could be used.

The actuator 100 illustrated in FIG. 1 and described above, is operated by supplying a pressurized fluid, such as air or gas, to the fluid inlet port 126 by, for example, opening an inlet valve 130. Substantially simultaneously, fluid egress from is prohibited by, for example, closing an outlet valve 132. Thus, the pressurized fluid enters the upper housing section 104 and pressurizes the internal chamber first portion 112. This causes the diaphragm assembly 200 to move the push rod 122 downwardly, against the force of spring 124, to position the connected component. When the component is no longer needed in this position, the inlet valve 130 is shut, and the outlet valve 132 is opened, depressurizing the internal chamber first portion 112. As a result, the spring 124 moves the push rod 122 upwardly, to thereby return the connected component to its original position.

Figure 2:
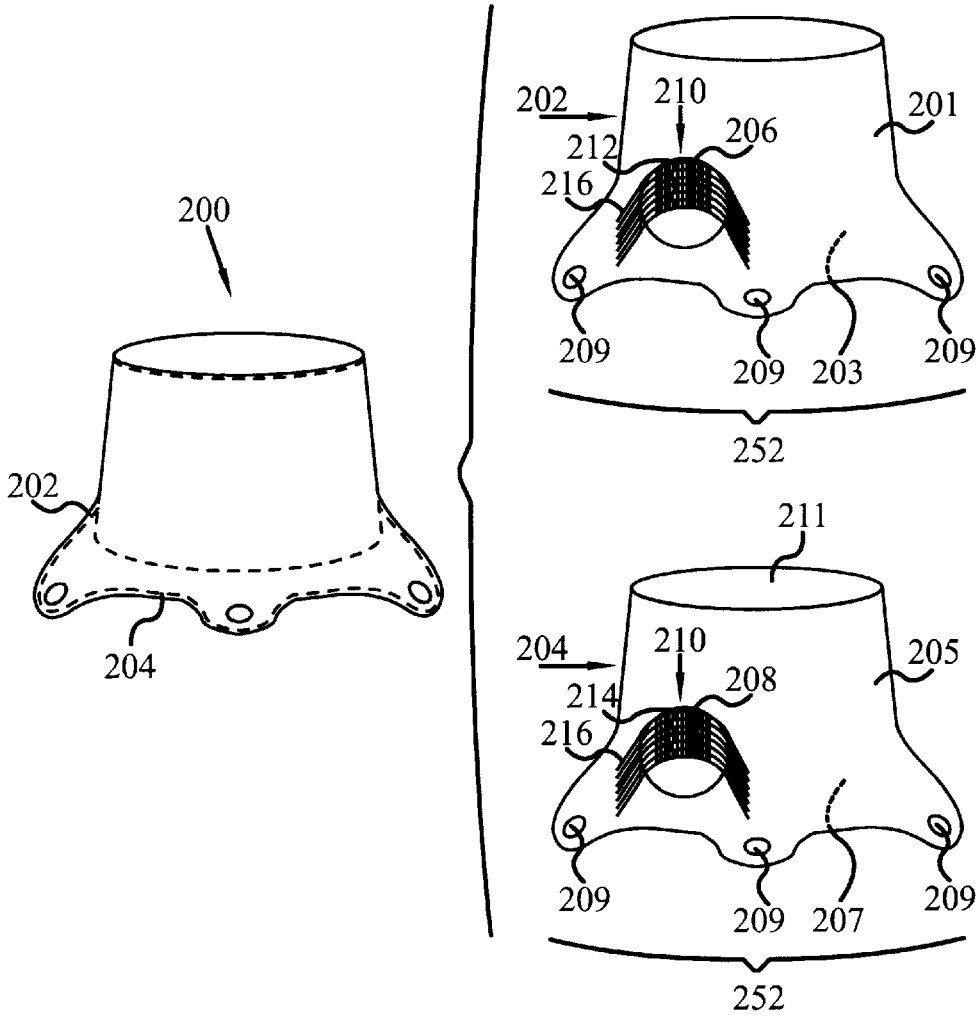
FIG. 2 illustrates an exemplary embodiment of a diaphragm assembly that may be used in the actuator depicted in FIG. 1.

Turning to FIG. 2, a detailed description of an exemplary embodiment of the diaphragm assembly 200 will now be provided. In the depicted embodiment, the diaphragm assembly 200 includes two individual diaphragms, a first diaphragm 202 and a second diaphragm 204. Both diaphragms are made of fabric 206 and 208 such as, for example, polyamide (nylon), fiberglass, or polyester. However, the fabric is preferably aromatic polyamide (e.g. Nomex®). It will be appreciated, however, that various other different materials, and combinations of different materials, may also be used. The first diaphragm 202 has an outer surface 201 and an inner surface 203. Similarly, the second diaphragm 204 includes an outer side surface 205 and an inner surface 207. A plurality of tabs 252 are spaced around an outer periphery of each diaphragm 202 and 204. Each of the tabs 252 has an opening 209 that extends between the diaphragm outer surfaces 201 and 205 and inner surfaces 203 and 207. The openings 209 allow fasteners, such as those depicted in FIG. 1, to pass therethrough to secure the diaphragm assembly 200 within the housing assembly 102. Depending on the way the diaphragms are fastened inside the actuator, the openings 209 may not be necessary.

Each diaphragm 202 and 204 is coated with an elastomer on at least one surface. In a particular preferred embodiment, each diaphragm 202 and 204 is coated with the elastomer on the surface that is exposed to pressurized gas. Thus, it may be either on the inner surface, the outer surface or both. In the depicted embodiment, the elastomer material is on the outer surfaces 203 and 207. The elastomer may be silicone, fluorosilicone, or fluorocarbon, although other suitable materials may be used. However, in the preferred embodiment, the elastomer is vinyl methyl silicone (VMQ) that exhibits enhanced heat resistance. More specifically, the preferred elastomer is a vinyl methyl silicone material that is heat resistance enhanced with a fine iron oxide powder (preferably less than 1%), which acts as an anti-oxidant, and Silastic® HT-1, a heat stability additive available from Dow Corning, in conjunction with a high temperature catalyst 2,5dimethyl-2,5-di-(t-butyl peroxy) which may be purchased under the trademark Varox® DBPH-50, and which is available from R. T. Vanderbilt Co.

The diaphragms 202 and 204 are initially made from a flat fabric sheet, and are then formed into a so-called "top hat" shape. Thus, as FIG. 2 depicts, after the diaphragms 202 and 204 are shaped, at least a portion of fabric 206 and 208 in each of the diaphragms 202 and 204 takes on one or more rainbow patterns 210. Each rainbow pattern 210 includes a top 212 and 214, and a side 216. In the preferred embodiment of the diaphragm assembly 200, the first 202 and second 204 diaphragms are aligned in a preferred configuration to obtain the desired utility. In particular, the top 212 of the rainbow pattern 210 of the first diaphragm 202 and the top 214 of the rainbow pattern 210 of the second diaphragm 204 are substantially aligned with one another. Such a configuration has been shown to markedly increase pneumatic actuator life. For example, testing has shown an increase in cycle time to failure of up to 566% in some actuator embodiments as compared with conventional, single diaphragm actuator configurations.

Figure 3:
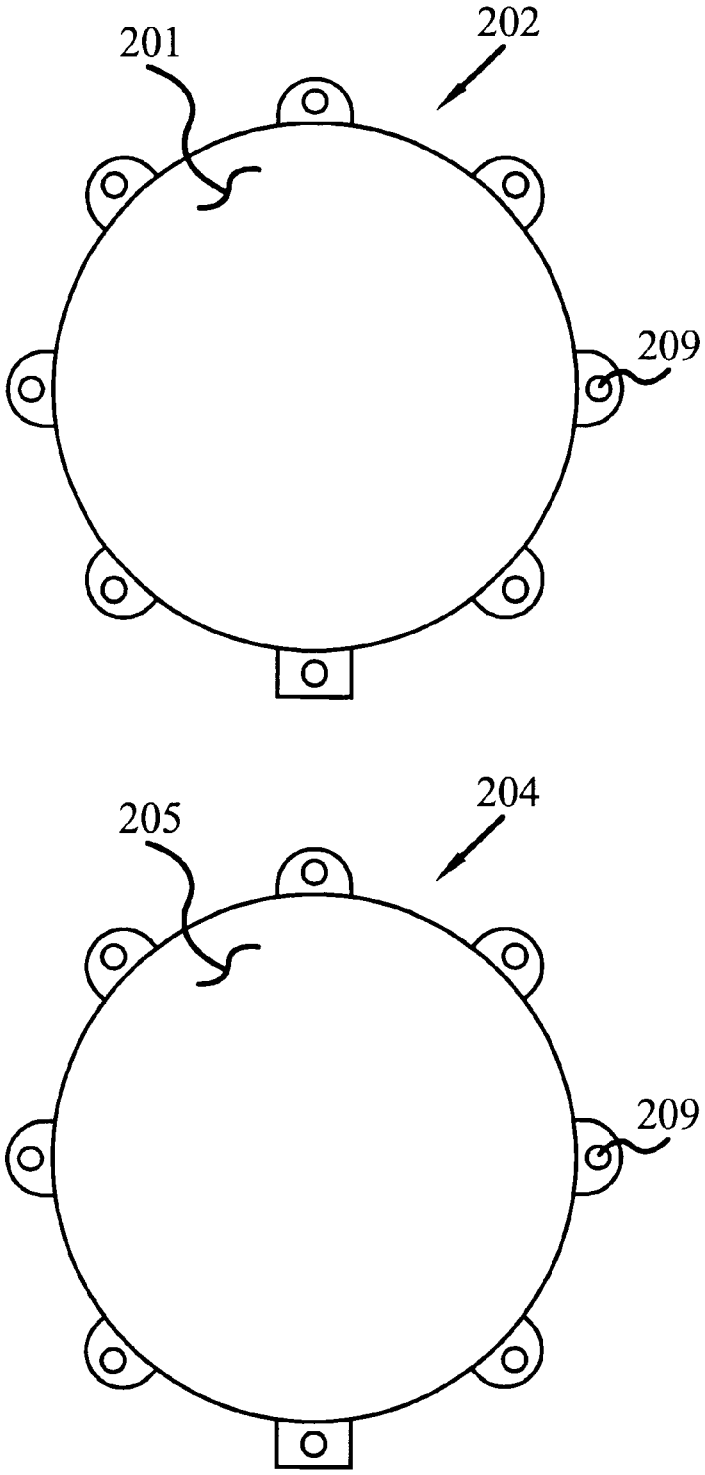
FIG. 3 is a simplified top view of two diaphragms that may be used to form the diaphragm assembly depicted in FIG. 2.

To help ensure that the assembly of the first 202 and second diaphragms 204 are properly aligned, preferably one of the tabs 252 is shaped differently from the others. For example, in the depicted embodiment, one tab 252 is substantially square, while the others are substantially round. A simplified top view of the first 202 and second 204 diaphragms showing the tabs 252 are depicted in FIG. 3. In this manner, the rainbow pattern tops 212 and 214 can be aligned during diaphragm assembly 200 installation. It will be appreciated that other methods could be used to facilitate proper alignment of the first 202 and second 204 diaphragms.

It will be appreciated that although the diaphragm assembly 200 is depicted and described herein as being constructed of two diaphragms, it could also be constructed of more than two diaphragms, if so desired for a particular application. It is additionally noted that the first 202 and second 204 diaphragms may be installed into the actuator 100 without being coupled together. Alternatively, the first 202 and second 204 diaphragms, with their rainbow patterns 210 aligned, may be coupled together using any one of numerous known adhesives or fasteners.

The diaphragm assembly 200 may be installed into a new actuator 100, as part of its initial manufacturing process, or the diaphragm assembly could be retrofitted into an existing actuator. For example, to retrofit an existing actuator 100, an operator would decouple the upper housing section 104 from the lower housing section 106 by removing the fasteners 110. The stops screw 120 may then be removed, to allow the backing plate 118 and existing diaphragm to be removed from the housing assembly 102. The diaphragm assembly 200 (which may include two or more individual diaphragms) may then be installed, with the fabric patterns properly aligned, and the backing plate 118, stop screw 120 replaced. The upper housing section 104 may then be coupled to the lower housing section 106. While it is preferable to replace an existing diaphragm with a new, double diaphragm assembly 200, it will be appreciated that the existing diaphragm could remain, and one or more diaphragms of substantially similar dimensions could be added to the actuator 100. It is preferable that the fabric patterns of the added diaphragms are aligned with that of the existing one.

The diaphragm assembly 200 increases the lifetime to repair of pneumatic actuators and significantly reduces the likelihood of curtain failures where the actuator is in service.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A pneumatic actuator assembly comprising:

a housing with an internal chamber and at least a first fluid port in fluid communication with the internal chamber;

a diaphragm assembly located in the internal chamber of the housing to prevent fluid communication between a first portion of the internal chamber and a second portion of the internal chamber, the first portion of the internal chamber being in fluid communication with the fluid port;

wherein the diaphragm assembly has a first diaphragm having an outer surface and an inner surface, and a second diaphragm having an outer surface and an inner surface, the second diaphragm outer surface positioned adjacent the first diaphragm inner surface; and wherein each of the first and second diaphragms has a fabric portion and has at least a portion of one of its surfaces covered with an elastomeric material, each fabric portion having at least one fabric pattern, and wherein the fabric patterns of the first and second diaphragms are substantially aligned with one another.

2. The actuator assembly of claim 1, further comprising:

a diaphragm support mounted in the housing, the diaphragm support having a first surface contacting the inner surface of the second diaphragm.

3. The actuator assembly of claim 2, further comprising:

a compression spring mounted in the housing between a second surface of the diaphragm support and the housing.

4. The actuator assembly of claim 1, further comprising:

a second fluid inlet port in fluid communication with the internal chamber.

5. The actuator assembly of claim 1, wherein the elastomeric material comprises vinyl methyl silicone with enhanced heat resistance.

6. The actuator assembly of claim 1, further comprising:

an adhesive to couple at least a portion of the first diaphragm to at least a portion of the second diaphragm.

7. The actuator assembly of claim 1, wherein the first and second diaphragm fabric patterns are substantially rainbow-shaped and each have at least a top, wherein the tops of the rainbow-shaped fabric patterns of the first and second diaphragms are substantially aligned with one another.

8. The actuator assembly of claim 1, further comprising:

at least two protrusions extending from a periphery of each diaphragm, wherein one of the protrusions on each diaphragm is shaped differently from other of the protrusions.

9. A diaphragm assembly, comprising:

a first diaphragm having an outer surface and an inner surface; and a second diaphragm having an outer surface and an inner surface, the second diaphragm outer surface positioned adjacent the first diaphragm inner surface, wherein each of the first and second diaphragms is made of a fabric material and has at least a portion of at least one of its surfaces covered with an elastomeric material; and wherein the fabric has at least one fabric pattern, and wherein the fabric patterns of the first and second diaphragms are substantially aligned with one another.

10. The diaphragm assembly of claim 9, wherein the elastomeric material comprises vinyl methyl silicone.

11. The diaphragm assembly of claim 10, wherein the elastomer further comprises iron oxide powder, a heat stability additive, and 2,5-dimethyl-2,5-di-(t-butyl peroxy) catalyst on an inert carrier.

12. The diaphragm assembly of claim 9, further comprising:

an adhesive coupling the first diaphragm lower surface to the second diaphragm upper surface.

13. The diaphragm assembly of claim 9, wherein the first and second diaphragm fabric patterns are substantially rainbow-shaped and each have at least a top, and wherein the tops of the rainbow-shaped fabric patterns of the first and second diaphragms are substantially aligned with one another.

14. The diaphragm assembly of claim 13, wherein each diaphragm is substantially top hat shaped.

15. The diaphragm assembly of claim 9, further comprising:

at least two protrusions extending from a periphery of each diaphragm, wherein one of the protrusions on each diaphragm is shaped differently from other of the protrusions.

16. A diaphragm assembly, comprising:

a first fabric diaphragm having a first fabric portion, the fabric portion having at least one fabric pattern therein; and a second fabric diaphragm having a second fabric portion, the fabric portion of the second diaphragm having at least one fabric pattern therein, each fabric pattern of the first diaphragm being substantially aligned with each fabric pattern of the second diaphragm.

17. The diaphragm assembly of claim 16, further comprising:

an elastomer covering at least a portion of each of the first and second fabric diaphragms.

18. The diaphragm assembly of claim 17, wherein the elastomer comprises vinyl methyl silicone.

19. The diaphragm assembly of claim 18, wherein the elastomer further comprises iron oxide powder, a heat stability additive, and 2,5-dimethyl-2,5-di-(t-butyl peroxy) catalyst on an inert carrier.

20. The diaphragm assembly of claim 16, further comprising:

an adhesive coupling at least a portion of the first fabric diaphragm to at least a portion of the second fabric diaphragm.

21. The diaphragm assembly of claim 16, wherein the first and second diaphragm fabric patterns are substantially rainbow-shaped and each have at least a top, and wherein the tops of the rainbow-shaped fabric patterns of the first and second diaphragms are substantially aligned with one another.

22. The diaphragm assembly of claim 16, further comprising:

at least two protrusions extending from a periphery of each diaphragm, wherein one of the protrusions on each diaphragm is shaped differently from other of the protrusions.

23. In an actuator having a housing assembly and a single diaphragm mounted therein, a method of modifying the actuator, comprising:

disassembling at least a portion of the housing assembly;

removing the diaphragm from the housing assembly; and installing a diaphragm assembly within the housing assembly, wherein the diaphragm assembly includes at least a first diaphragm and a second diaphragm positioned adjacent one another wherein each of the first and second diaphragms has a fabric portion having at least one fabric pattern, wherein the fabric patterns of the first and second diaphragms are substantially aligned with one another.

24. The method of claim 23, wherein:

the first diaphragm has an upper surface and a lower surface, and the second diaphragm has an upper surface and a lower surface, the second diaphragm upper surface positioned adjacent the first diaphragm lower surface; and each of the first and second diaphragms has at least a portion of one of its surfaces covered with an elastomeric material.

25. In an actuator having a housing assembly having a first diaphragm mounted therein, the first diaphragm including a fabric portion having at least one fabric pattern, a method of modifying the actuator, comprising:

disassembling at least a portion of the housing assembly; and installing at least a second diaphragm within the housing assembly and positioned adjacent the first diaphragm, the second diaphragm including a fabric portion having at least one fabric pattern, wherein the fabric patterns of the first and second diaphragms are substantially aligned with one another.

26. A method of aligning two or more diaphragms in a preferred orientation, comprising:

forming two or more protrusions on each diaphragm, at least one of the protrusions on each diaphragm being shaped differently from other of the protrusions; and aligning the differently shaped protrusion on one diaphragm with the differently shaped protrusion on other of the diaphragms.

* * * * *